US006539628B2

(12) United States Patent
Akutsu et al.

(10) Patent No.: US 6,539,628 B2
(45) Date of Patent: Apr. 1, 2003

(54) FORMED STRIP AND ROLL FORMING

(75) Inventors: Tomoaki Akutsu, Gunma (JP); Natsuko Hirayanagi, Tochigi (JP); Harumi Obata, Gunma (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/140,106

(22) Filed: May 8, 2002

(65) Prior Publication Data

US 2002/0136918 A1 Sep. 26, 2002

Related U.S. Application Data

(62) Division of application No. 09/414,638, filed on Oct. 8, 1999, now Pat. No. 6,423,423.

(51) Int. Cl.[7] ..... B23P 15/26; F28F 1/02; B21D 53/08

(52) U.S. Cl. ..... 29/890.049; 29/727; 72/252.5; 72/368

(58) Field of Search ..... 428/595, 603, 428/599, 577, 582, 586, 600; 29/890.049, 727, 33 G, 33 D; 72/252.5, 379.2, 368

(56) References Cited

U.S. PATENT DOCUMENTS

| | | | | |
|---|---|---|---|---|
| 1,499,986 A | | 7/1924 | Kirsch | |
| 2,034,550 A | | 3/1936 | Adams | |
| 3,395,438 A | | 8/1968 | Seeff | |
| 5,456,006 A | * | 10/1995 | Study | 29/890.049 |
| 6,109,085 A | | 8/2000 | Kikuchi et al. | |
| 6,276,513 B1 | | 8/2001 | Asano et al. | |
| 6,315,158 B1 | | 11/2001 | Yoshida et al. | |
| 6,418,614 B2 | * | 7/2002 | Akutsu et al. | 29/712 |
| 2001/0037559 A1 | * | 11/2001 | Prater et al. | 29/726 |
| 2001/0049878 A1 | * | 12/2001 | Kato et al. | 29/890.049 |

FOREIGN PATENT DOCUMENTS

| | | |
|---|---|---|
| GB | 1 547 685 | 6/1979 |
| JP | 60-247426 | 12/1985 |
| JP | 03-166023 | 7/1991 |
| JP | 03-199896 | 8/1991 |
| JP | 04-028437 | 1/1992 |
| JP | 04-028438 | 1/1992 |
| JP | 04-035831 | 3/1992 |
| JP | 04-113113 | 10/1992 |
| JP | 06-114455 | 4/1994 |
| JP | 08-327266 | 12/1996 |
| JP | 09-068394 | 3/1997 |
| JP | 09-085541 | 3/1997 |
| JP | 09-085542 | 3/1997 |
| JP | 10-015619 | 1/1998 |
| JP | 11-070424 | 3/1999 |

* cited by examiner

*Primary Examiner*—John J. Zimmerman
(74) *Attorney, Agent, or Firm*—Foley & Lardner

(57) ABSTRACT

A V-shaped metal strip has a U-shaped bottom having U-shaped inside and outside surfaces. Only the U-shaped inside surface is formed with a plurality of fold lines extending in a longitudinal direction of the strip and reducing the influence of springback. The fold lines may be arranged in a manner of bilateral symmetry with respect to an imaginary median plane bisecting the V-shaped cross section of the metal strip.

4 Claims, 13 Drawing Sheets

5
2
3
4
1
F
T
6
31
34

FORMED STRIP AND ROLL FORMING

This application is a divisional of U.S. patent application Ser. No. 09/414,638, filed Oct. 8, 1999, now U.S. Pat. No. 6,423,423 and is incorporated herein by reference.

BACKGROUND OF THE INVENTION

The present invention relates to a formed strip such as a roll formed strip, and a roll forming method or system.

In particular, the present invention relates to a stage for forming tubes in a production system for producing heat exchangers for air conditioners, including stages for producing header pipes by press working to form a flat, sheet or plate to a cylindrical shape, for producing U-shaped holders by roll forming from a metal strip, for inserting, in each holder, an inner fin formed, by press forming or roll forming, for forming tubes, such as heat exchanger tubes, from each holder, for forming corrugated outer fins by a corrugate cutter, and for assembling heat exchanger tubes, outer fins, and header pipes.

Tubes for conveying a fluid such as refrigerant is widely used in heat exchange devices such as a condenser of a refrigeration cycle for a motor vehicle, an evaporator and a radiator. In one production method, a refrigerant tube is formed by bending a flat metal strip.

SUMMARY OF THE INVENTION

When a metal tube is formed by applying pressure from both sides on a V-shaped metal strip until a V-shaped cross section is converted into a closed elongate cross section, the closure and joining of both edges of the open V-shaped cross section into the closed cross section is not easy because of undesired springback due to compressive stresses on the inner side of the curved portion of the metal strip and tensile stresses on the outer side. Moreover, springback tends to degrade the accuracy of the U-shaped or V-shaped cross section formed by bending operation.

It is therefore an object of the present invention to provide a formed strip which can be made securely into a tube with no or little influence of springback.

It is another object of the present invention to provide a bending method or system which can bend a strip accurately with no or little influence of springback It is still another object of the present invention to provide a method or system for forming flanged strips of different sizes in a manner reducing the production cost.

According to a first aspect of the present invention, a V-shaped metal strip having a V-shaped cross section for forming a metal tube having an closed elongated cross section comprises a U-shaped portion having a U-shaped curved inside surface and a U-shaped curved outside, surface. Only the inside curved surface is formed with a plurality of fold lines extending in a longitudinal direction of the V-shaped metal strip.

According to a second aspect of the present invention, a bending method of bending a metal strip from a flat shape into a folded shape having an approximately U-shaped cross section comprises a preceding bending step and a following bending step.

The preceding bending step is for compressing the metal strip between a wider concave roll having a circumferential rim formed with a wider V-shaped groove defined by left and right sloping surfaces forming a wider spread angle and a wider convex roll having a circumferential rim formed with a wider ridge projecting toward a middle of the V-shaped groove between the left and right sloping surfaces and having a left edge for pressing the metal strip at a left preceding pressing point against the left sloping surface and a right edge for pressing the metal strip at a right preceding pressing point against the right sloping surface.

The following bending step is for compressing the metal strip between a narrower concave roll having a circumferential rim formed with a narrower V-shaped groove defined by left and right sloping surfaces forming a narrower spread angle smaller than the wider spread angle of the preceding bending step and a narrower convex roll having a circumferential rim formed with a narrower ridge projecting toward a middle of the narrower V-shaped groove between the left and right sloping surfaces and having a left edge for pressing the metal strip at a right following pressing point against the left sloping surface and a right edge for pressing the metal strip at a left following pressing point against the right sloping surface, the left and right following pressing points being located between the left and right preceding pressing points.

A forming or bending method for forming a folded metal strip according to the second aspect of the invention may comprise a sequence of bending steps, each for applying two parallel pushing forces on a metal strip at two application points toward a V-shaped groove forming an angle. The distance between the two application points and the angle of the V-shaped groove are decreased step by step in the sequence of the bending steps.

According to a third aspect of the present invention, a roll forming system comprises first and second roll.

The first roll includes a main roll section having a main roll surface for pressing a main strip section of a strip and a side roll section raised from main roll surface of the first roll and having a side roll surface for forming a flange in the strip.

The second roll includes a main roll section having a main roll surface for compressing the main strip section of the strip between the main roll surfaces of the first and second rolls, a side roll section depressed below the main roll surface of the second roll and having a first side roll surface for forming the flange in the strip with the side roll surface of the first roll when the first roll has the side roll section at a first axial location confronting the first side roll surface of the side roll section of the second roll, and an annular groove formed axially between the main roll section of the second roll and the side roll section of the second roll, for forming the flange in the strip with the side roll surface of the first roll when the first roll has the side roll section at a second location for fitting in the annular groove of the second roll.

DETAILED DESCRIPTION OF THE INVENTION

Figure 1:
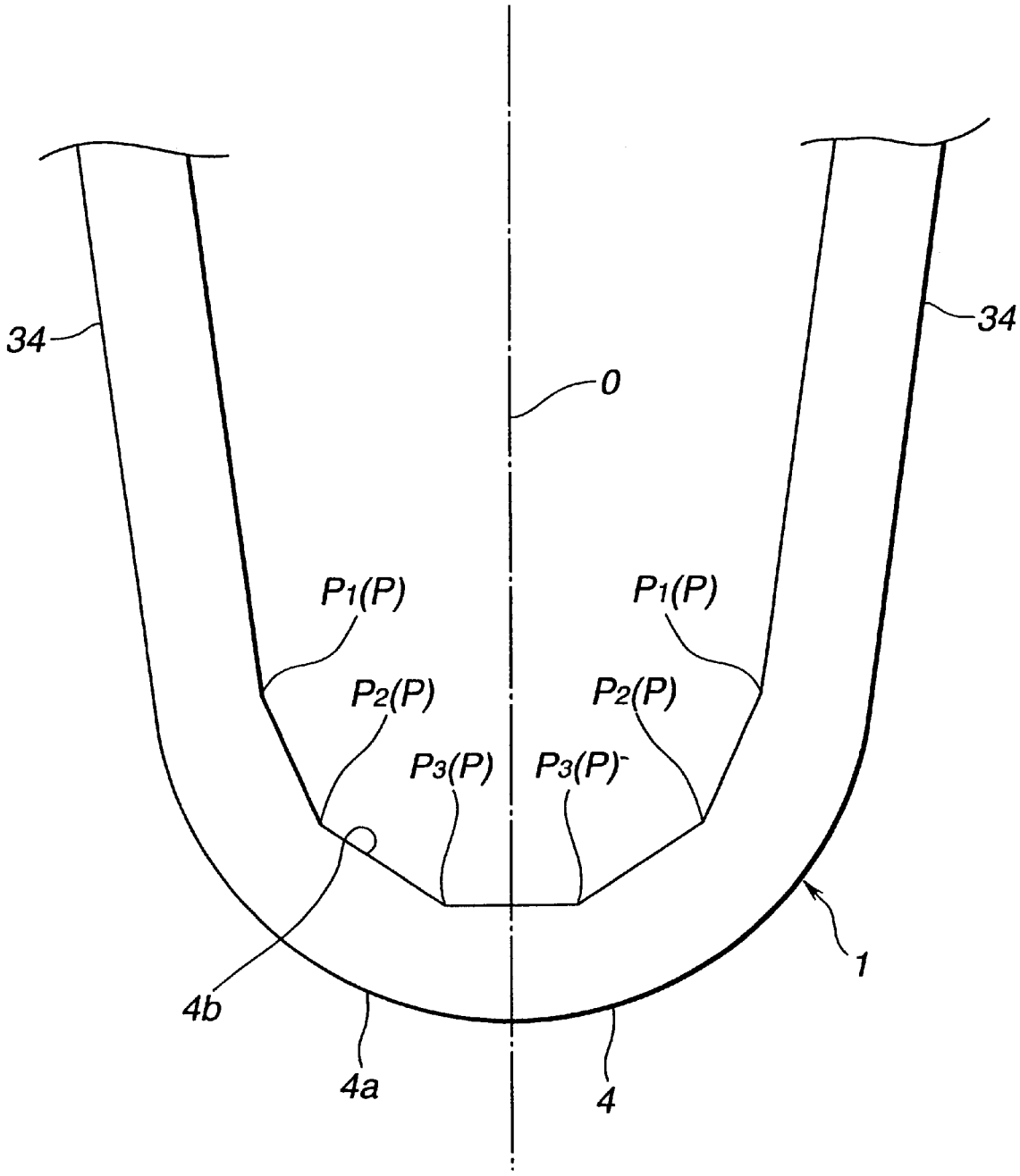
FIG. 1 is an enlarged sectional view showing a part of a formed metal strip according to a first aspect of the present invention.

FIG. 1 shows a formed or folded metal strip 1 for serving as a material for forming a metal tube having an elongated cross section according to the present invention. The metal strip 1 is made of metallic material, such as aluminum or aluminum alloy, light in weight and superior in heat conductivity.

Figures 2A, 2B, 2C, 2D:
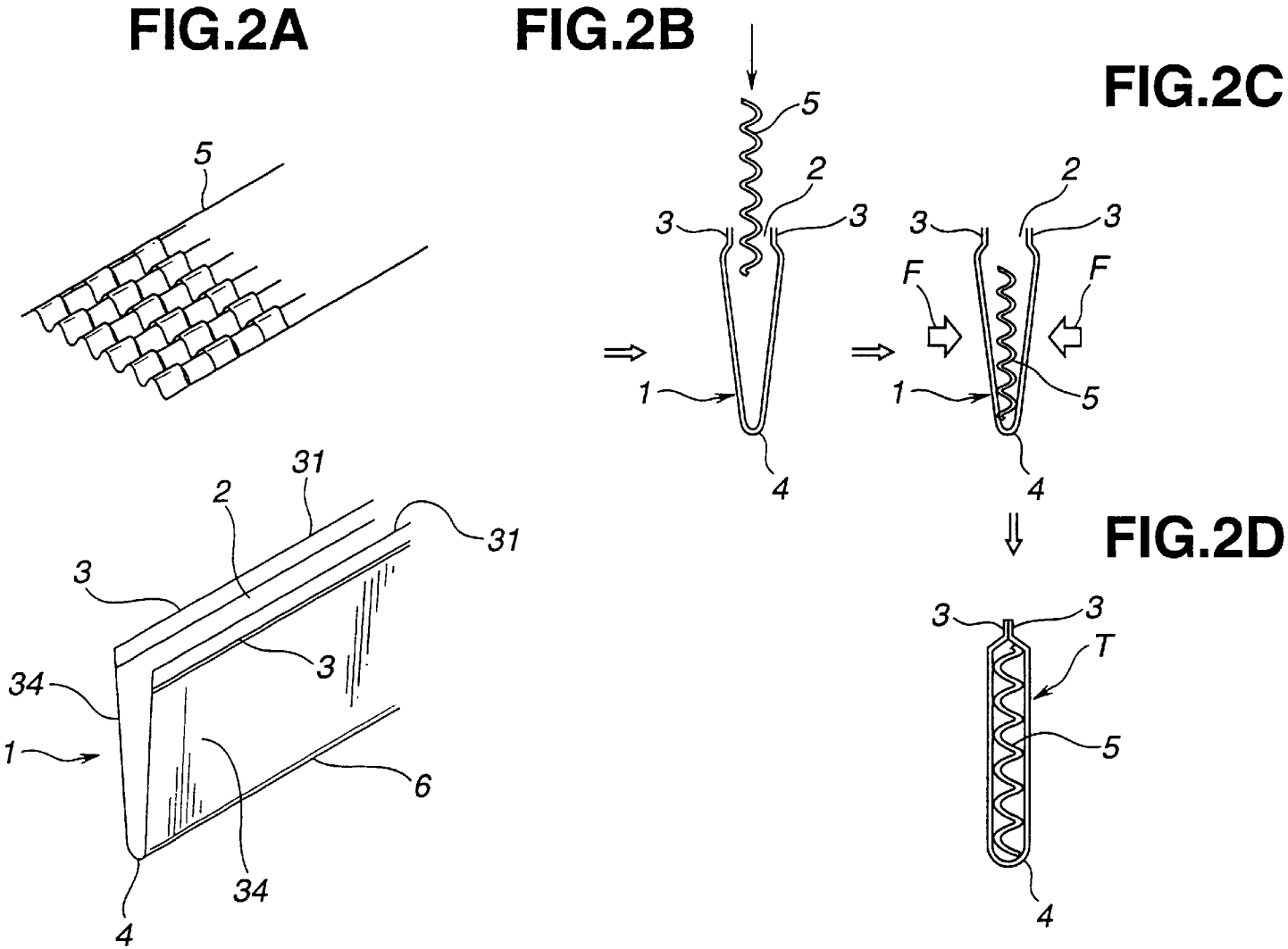
FIGS. 2A~2D are views for illustrating a sequence of steps for producing a tube from the formed metal strip of FIG. 1.
Figure 3A:
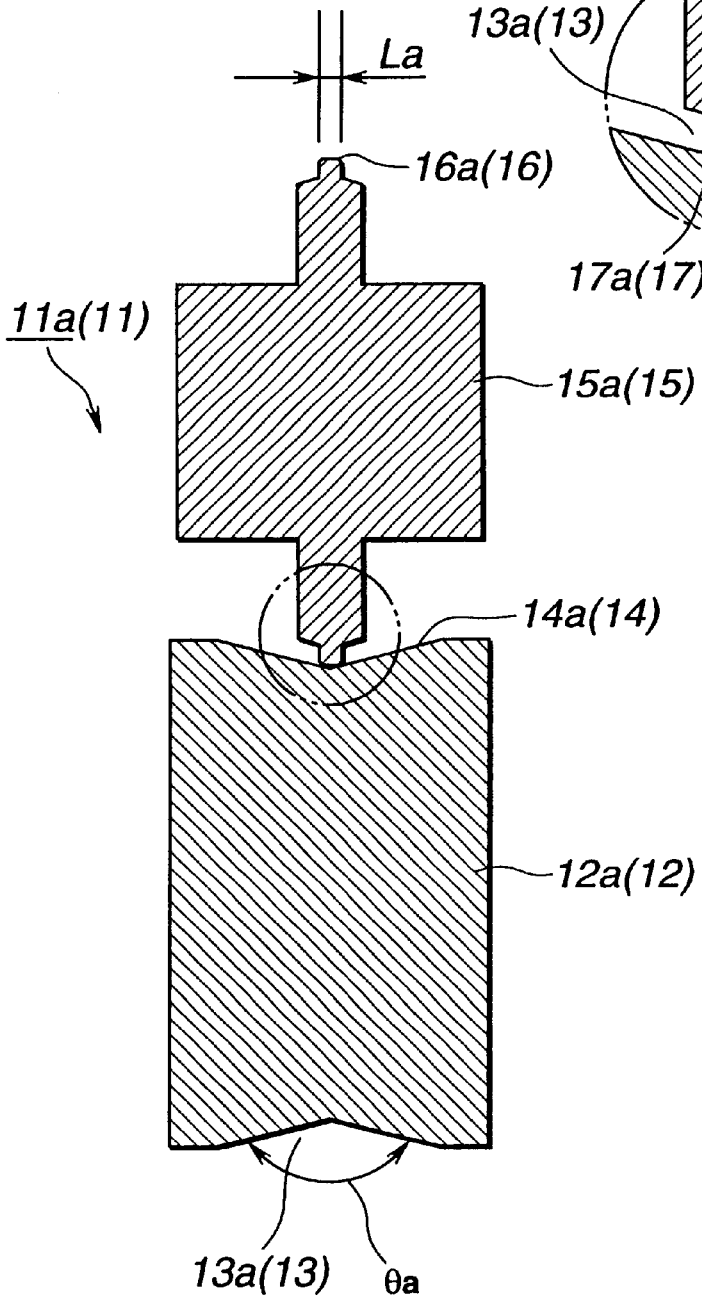
FIGS. 3A–B to 9A–9B are sectional views showing seven forming roll sets used in one production method for producing the formed metal strip shown in FIG. 1.
Figure 3B:
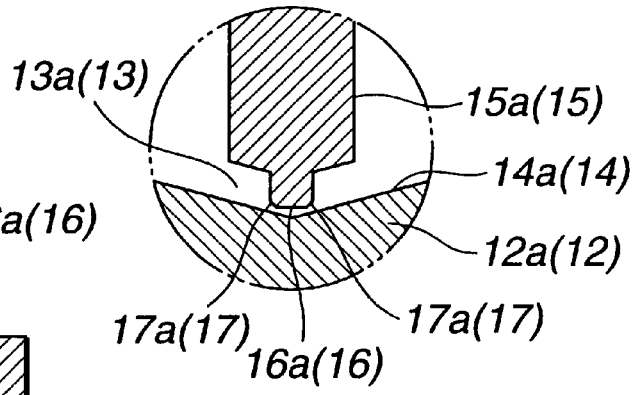

The formed metal strip 1 shown in FIG. 1 has a V-shaped cross section extending in a widthwise direction from an open lateral end 2 to a closed lateral end 6 as shown in FIG. 2A. In this example, the formed metal strip 1 has first and second (or left and right) flanges 3 terminating, respectively, at first and second (or left and right) edges 31 of the formed metal strip 1. In the state of FIG. 2A, the first and second flanges 3 are separated from each other and define a gap of the open end 2 extending in a longitudinal direction from a first longitudinal end of the formed strip 1 to a second longitudinal end.

The folded metal strip 1 has first and second (or left and right) side portions or side walls 34 and a U-shaped curved portion 4 connecting the first and second side portions 34 to form the V-shaped cross section. In this example, the first and second side portions 34 are substantially flat, and diverge, respectively, from first and second ends of the U-shaped portion 4 so as to form a V shape in cross section.

The U-shaped curved portion 4 has an outside U-shaped surface 4*a* and an inside U-shaped surface 4*b*. Only the inside U-shaped surface 4*b* is formed with a plurality of fold lines P which extend in the longitudinal direction of the metal strip 1 and which are arranged in a circumferential direction of the U-shaped inside surface 4*b*. The inside surface 4*b* is bent along each of the fold lines P. Along each fold line P, two surface regions meet and form an angle such as an obtuse angle.

The fold lines P are located away from an imaginary median plane O bisecting the V-shaped cross section of the V-shaped metal strip 1. In FIG. 1, the imaginary median plane appears as a center line O. Moreover, in the example of FIG. 1, there are formed three pairs of fold lines. The first pair consists of left and right (or first and second) outer fold lines P1 which are arranged substantially in a manner of bilateral symmetry with respect to the median plane O. The second pair consists of left and right (first and second) intermediate fold lines P2 arranged symmetrically in the manner of bilateral symmetry with respect to the median plane O. The third pair consists of left and right (or first and second) inner fold lines P3 arranged symmetrically in the manner of bilateral symmetry with respect to the median plane O. The distance between the left and right outer fold lines P1 is greater than the distance between the left and right intermediate fold lines P2. The height (or distance) of the outer fold lines P1 from the bottom end 6 of the formed metal strip 1 is greater than the height (or distance) of the intermediate fold lines P2. The distance between the left and right inner fold lines P3 is smaller than the distance between the left and right intermediate fold lines P2. The height (or distance) of the inner fold lines P3 from the bottom end 6 of the formed metal strip 1 is smaller than the height (or distance) of the intermediate fold lines P2.

The formed metal strip 1 can be formed into the V shape by roll forming or extrusion. In the case of roll forming, a metal strip is bent progressively by a sequence of a first step for bending the strip along each of the outer fold lines P1, a second step of further bending the strip along each of the intermediate fold lines P2 and a third step of further bending the strip along the inner fold lines P3. In the case of extrusion, the cross sectional shape of FIG. 1 is obtained by setting the shape of a die.

The formed metal strip 1 can be used as a material for forming a metal tube T for conveying a fluid such as a refrigerant for a heat transfer device such as a condenser. In this case, the metal tube T can be formed as shown in FIGS. 2A~2D. First, the formed metal strip 1 and an inner fin 5 are prepared as shown in FIG. 2A. Second, the inner fin 5 is inserted into the formed metal strip 1 from the gap at the open end 2 of the formed metal strip 1. The inner fin 5 of this example is a corrugated strip of the same material as the metal strip 1 and extending in a widthwise direction from a first lateral end to a second lateral end. In the inserted state, one lateral end reaches the bottom of the V-shaped inside cavity of the formed metal strip 1. Third, the V-shaped metal strip 1 is deformed with a press forming machine (not shown) by applying a predetermined pressure F from both sides in the thickness direction of the formed strip into a closed cross sectional shape, as shown in FIG. 2. In this closed state, the left and right edges 3 of the formed metal strip 1 are brought into contact with each other, and the left and right flanges 31 are superposed together. Then, the superposed flanges 31 are compressed tightly and joined together by staking or caulking, for example. The inner fin 5 is fixedly confined in the closed metal tube T, as shown in FIG. 2D.

In the operation with the press forming machine for further bending the formed metal strip 1 having the V-shaped cross section into the shape having the closed elongate cross section by applying pressure from both sides as shown in FIG. 2C, each of the fold lines P serves as an axis of bending, and promotes bending deformation of the metal strip 1. Moreover, internal stresses in the U-shaped portion 4 are distributed among the fold lines P, so that the fold lines P function to reduce springback. The reduction of springback facilitates the conversion of the metal strip from the V-shaped cross section to a desired closed elongate cross section, and further facilitates the operation of fixing the flanges 3 together by brazing or welding, for example, in the later finishing step.

The fold lines P are formed only in the inside U-shaped surface 4*b*, and the outside U-shaped surface 4*a* remains in the form of a smooth curved surface. Therefore, the outside of the U-shaped portion 4 of the metal tube T has a good appearance free of irregularities and flaws.

In the example of FIG. 1, the fold lines P1, P2 and P3 are arranged symmetrically on both sides of the imaginary median plane O. The symmetrical arrangement helps prevent stress concentration at the median plane, and prevents bending deformation along the median plane which could cause a crack. Moreover, the symmetrical arrangement of the fold lines P promotes symmetrical folding of the metal strip and secures the desirable shape free from crush, and shape errors.

The formed metal strip 1 can be used as a material for forming a refrigerant tube having an inner fin for a condenser as mentioned before, and as a material for forming a refrigerant tube for an evaporator and a radiator with the same effects.

Figure 4A:
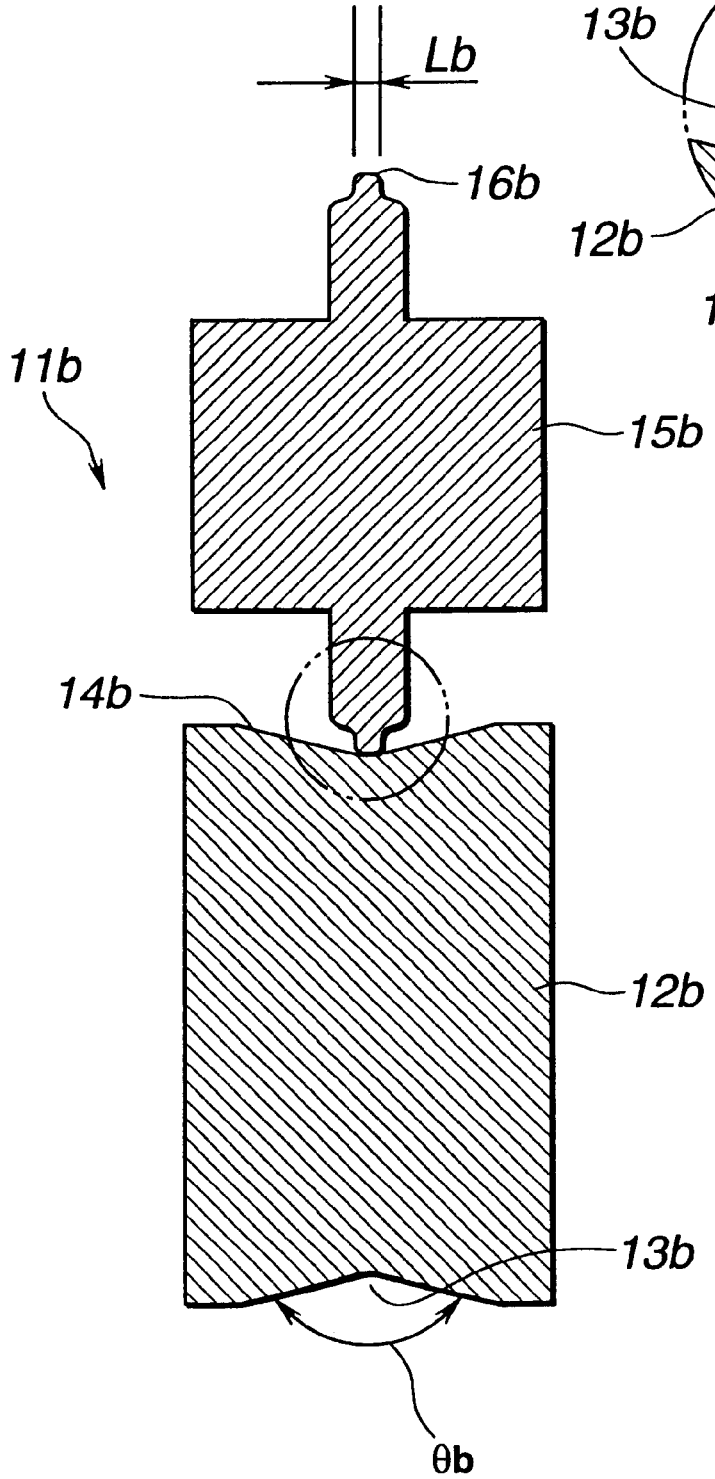
Figure 4B:
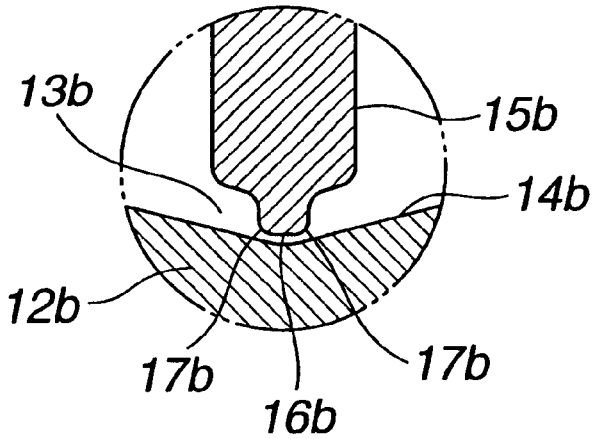

FIGS. 3A–B to 9A–9B shows 7 roll forming machines (or mills) 11 each having a roll set or roll pair, used in a production process according to the present invention for producing a formed metal strip as shown in FIG. 1. The production process of this example includes a sequence of seven roll bending steps or passes. FIG. 3 shows a first forming roll set 11*a* for the first bending step or pass. FIG. 4 shows a second roll forming set 11*b* for the second bending step or pass. Similarly, FIGS. 5, 6, 7, 8 and 9 show, respectively, third, fourth, fifth, sixth and seventh forming roll sets 11*c*, 11*d*, 11*e*, 11*f* and 11*g* for the third, fourth, fifth, sixth and seventh bending steps.

Each roll set 11(11*a*~11*g*) includes a concave roll 12(12*a*~12*g*) with a circumferential rim formed with a V-shaped groove 13(13*a*~13*g*), and a convex roll 15(15*a*~15*g*) with a circumferential rim formed with a ridge 16(16*a*~16*g*) projecting radially toward the deepest middle of the V-shaped groove of the mating concave roll. In the example shown in FIGS. 3~9, each roll has a shape of bilateral symmetry. An imaginary median plane divides the concave and convex rolls of each pair into left and right equal halves.

Figure 5A:
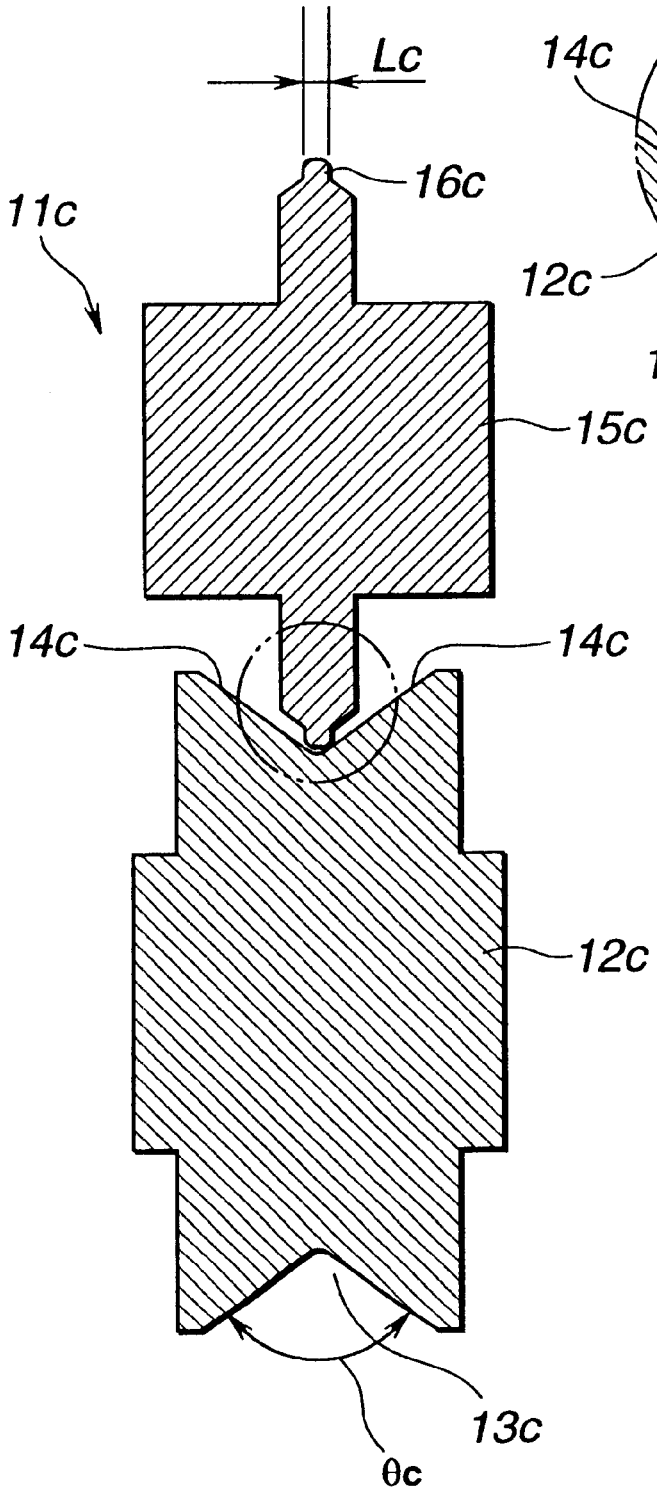
Figure 5B:
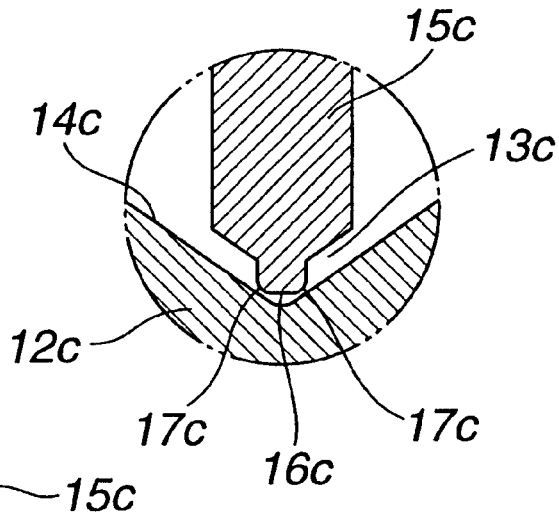
Figure 6A:
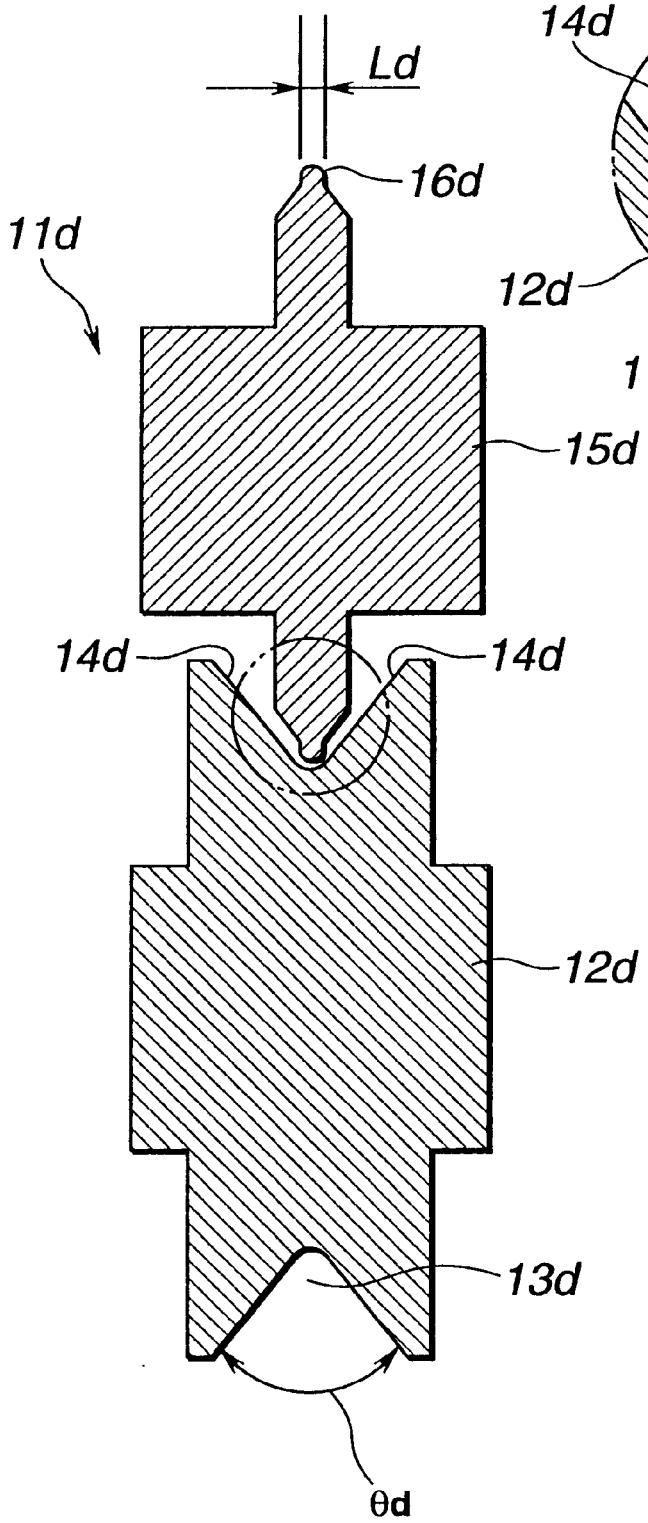
Figure 6B:
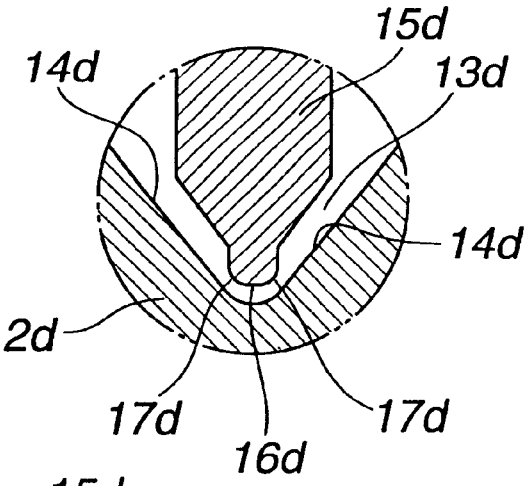
Figure 7A:
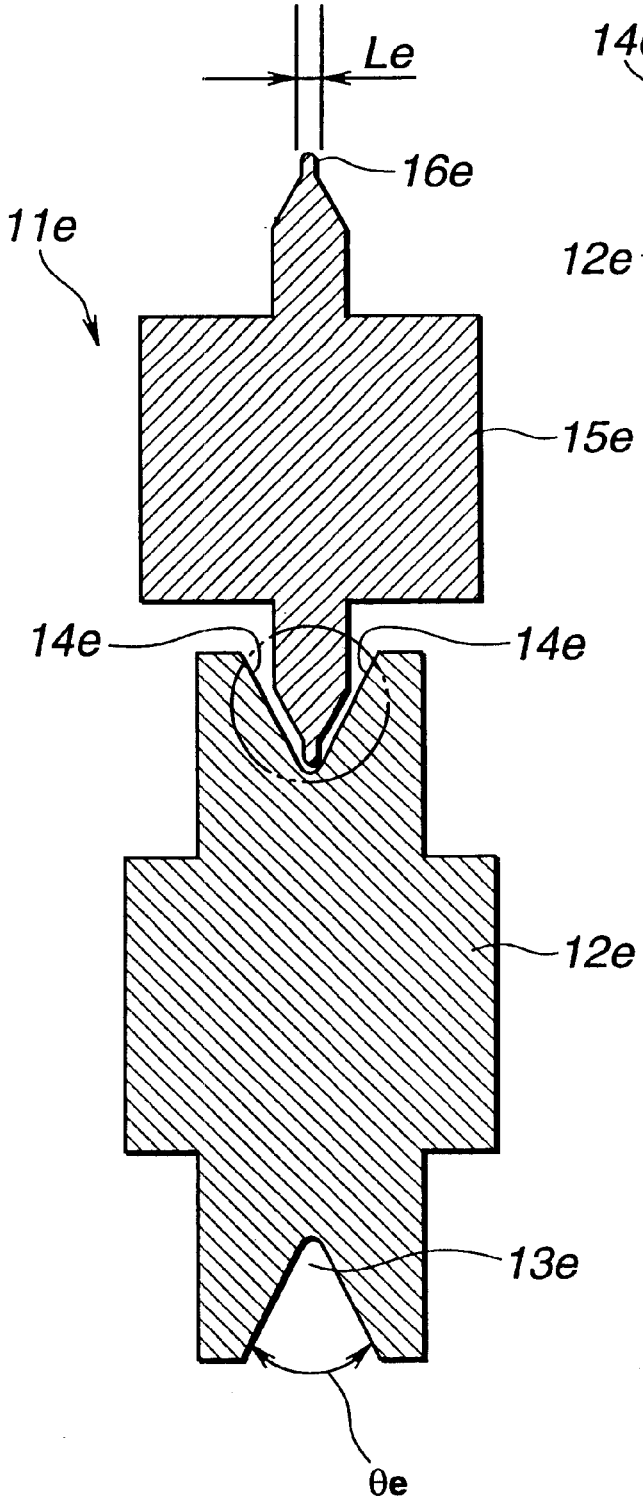
Figure 7B:
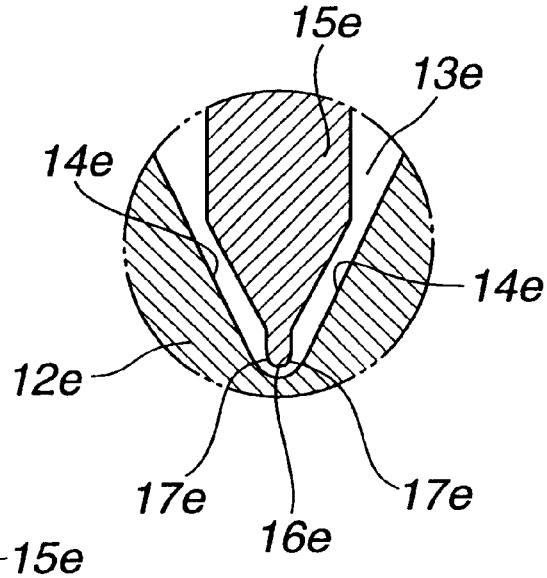
Figure 8A:
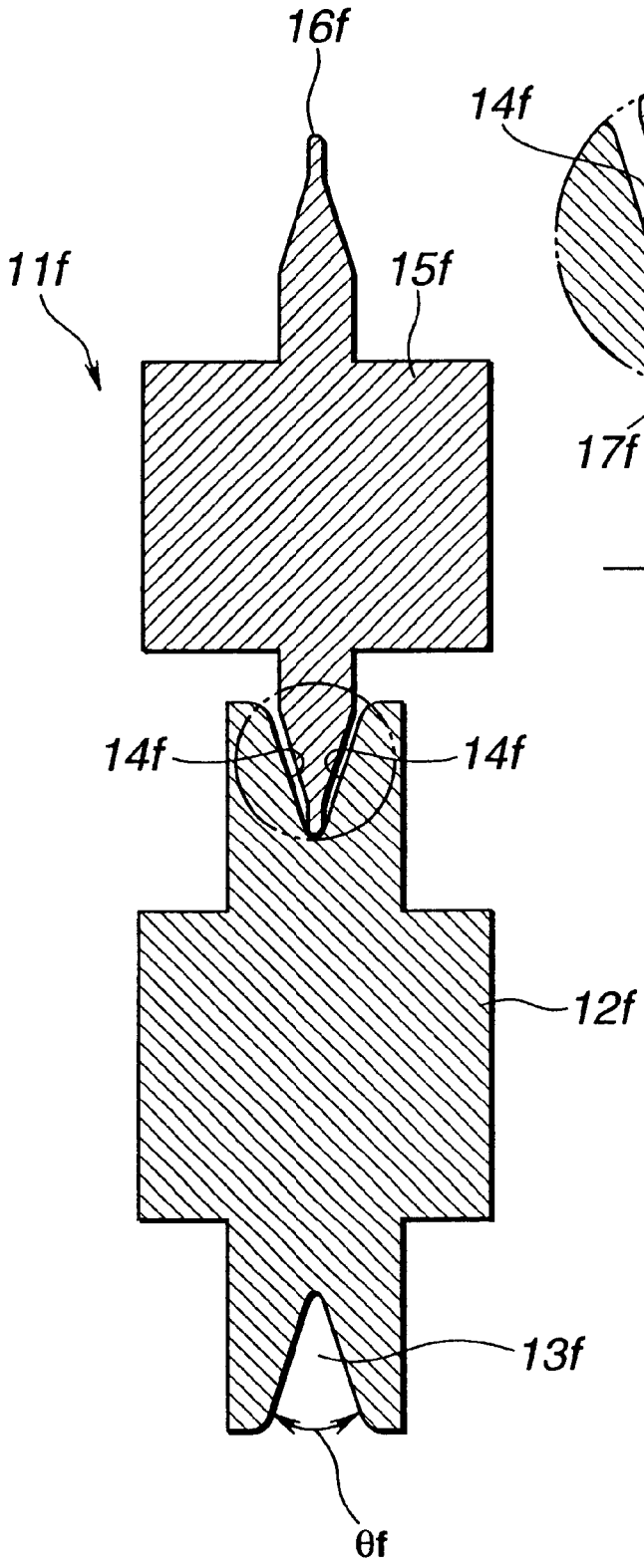
Figure 8B:
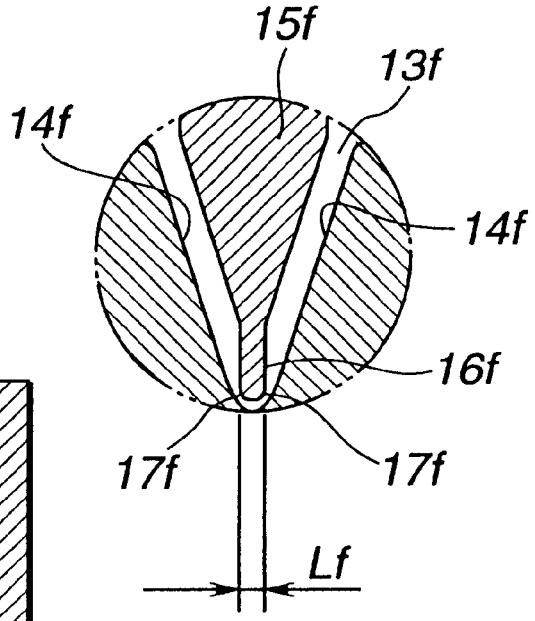
Figure 9A:
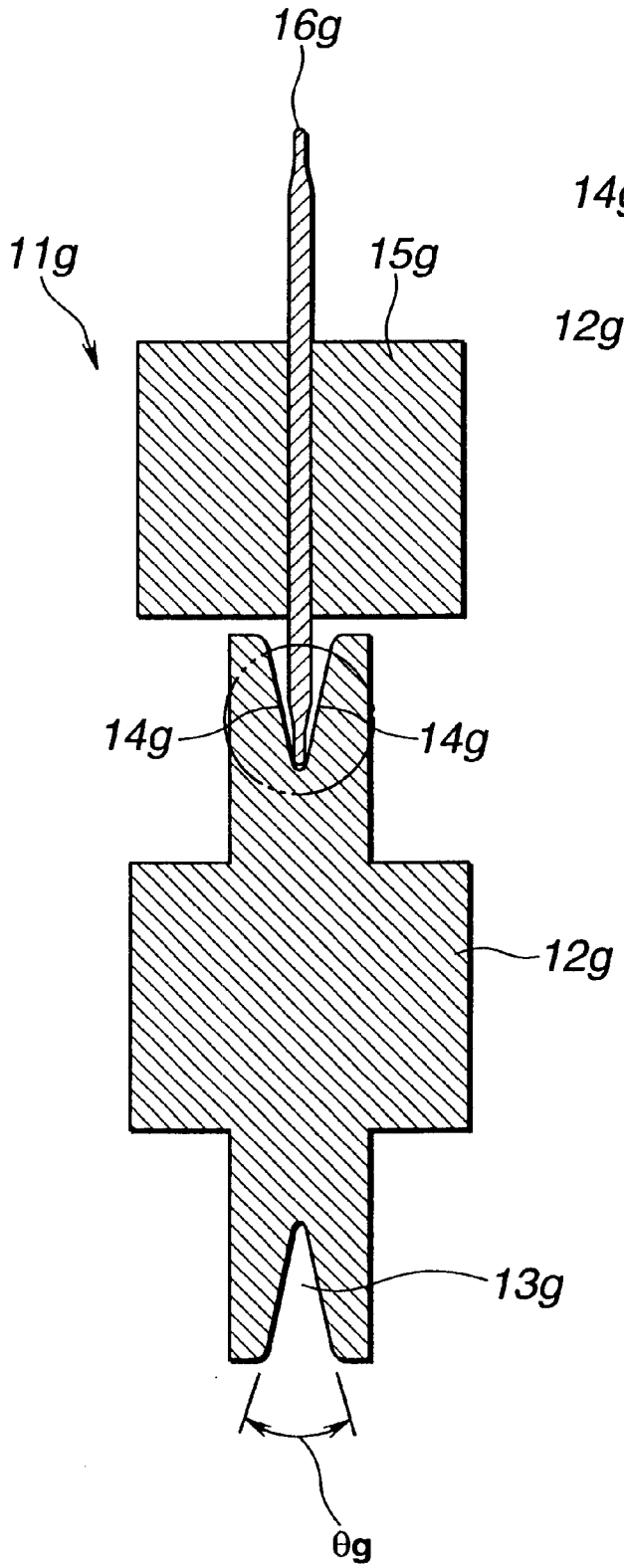
Figure 9B:
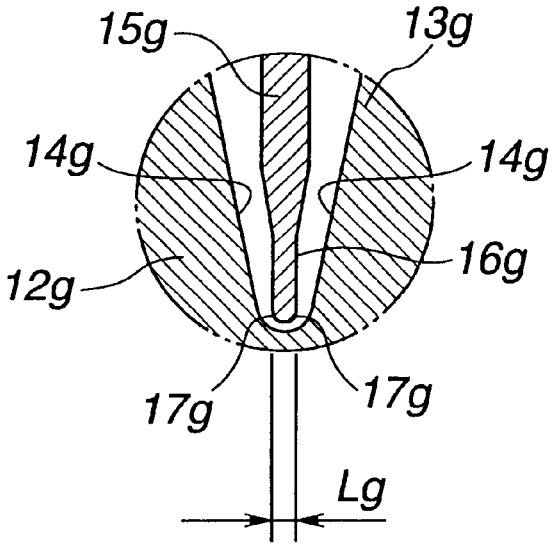

Each of the V-shaped grooves 13*a*~13*g* of the concave rolls 12*a*~12*g* has first and second (left and right) sloping surfaces 14(14*a*~14*g*) defining a spread angle θ (θa~θg) of the V-shaped groove as shown in FIGS. 3~9. In this example, each sloping surface is a conical surface and appears as a straight line segment in the sectional views of FIGS. 1~9. The spread angle is decreased gradually step by step in the order of the seven bending steps of the sequence. The spread angle θb of the second bending step shown in FIG. 4 is smaller than the spread angle θa of the first bending step of FIG. 3. The spread angle θc of the third bending step shown in FIG. 5 is smaller than the spread angle θb of the second bending step of FIG. 4. Thus, θa>θb>θc>θd>θe>of>θg.

Each of the ridges 16*a*~16*g* of the convex rolls 15*a*~15*g* has first and second (left and right) edges 17(17*a*~17*g*) confronting the first and second (left and right) sloping surfaces of the mating concave roll. In this example, the ridge 16 of each convex roll is in the form of a flange defined between first and second (left and right) flat surfaces extending radially. The first edge is formed between the first flat surface and a circumferential surface of the flange, and the second edge is formed between the second flat surface and the circumferential surface of the flange. The width of the ridge 16 measured along the axial direction defines an axial width of pressure application. The width of the ridge 16 is decreased gradually step by step in the order of the seven bending steps of the sequence. The width Lb of the second bending step shown in FIG. 4 is smaller than the width La of the first bending step of FIG. 3. The width Lc of the third bending step shown in FIG. 5 is smaller than the width Lb of the second bending step of FIG. 4. Thus La>Lb>Lc>Ld>Le>Lf>Lg.

Figure 10:
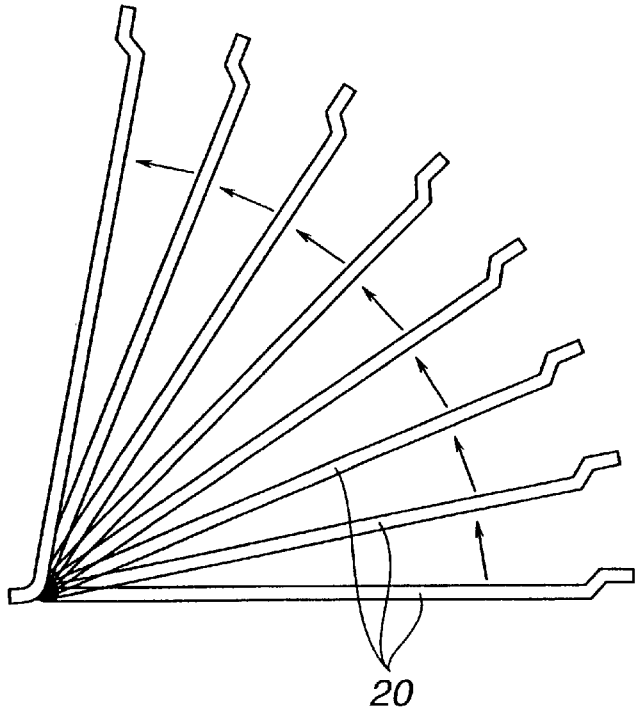
FIG. 10 is a schematic view showing one half of a metal strip bent step by step by the roll pairs shown in FIGS. 3~9.

A strip 20 is passed through the seven roll set 11*a*~11*g* successively, and thereby bent step by step from a flat form to a U-shaped form as shown in FIG. 10. In this example, the strip has flanges formed by the later-mentioned method shown in FIGS. 12~16C.

Figure 11:
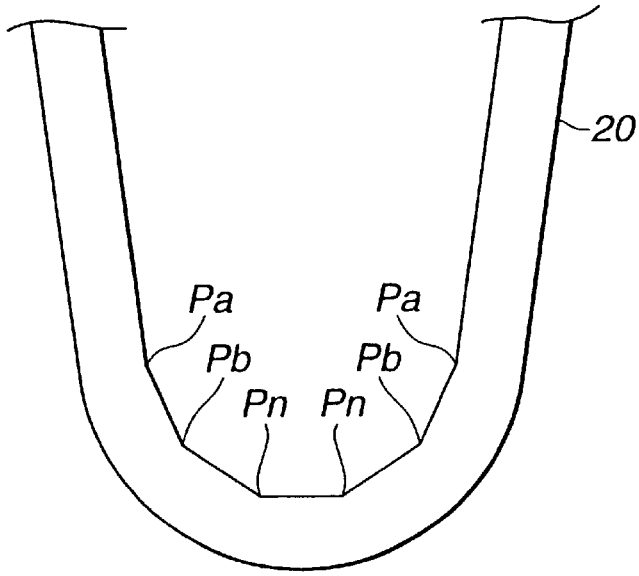
FIG. 11 is a sectional view showing a metal strip having fold lines produced by the roll pairs shown in FIGS. 3~9.

As shown in FIG. 11, the inside U-shaped surface of the strip 20 bent by the sequence of the bending steps has a first pair of fold lines Pa formed by the left and right edges 17*a* of the first convex roll 15*a* shown in FIG. 3. On each of the left and right side of the median plane, the left or right edge 17*a* applies a pressing force on the strip 20 at an application point, and forms the fold line Pa extending, at that application point, in the longitudinal direction of the strip 20. The inside surface is folded along the fold line Pa. The left and right edges 17*b* of the second convex roll 15*b* form a second pair of fold lines Pb located between the first pair of the fold lines Pa. Similarly, the left and right edges of the subsequent bending step form a subsequent fold lines Pc~Pg (Pn). In FIG. 11, the shape of the formed strip 20 is simplified.

The fold lines formed by a subsequent bending step which is any of the second through last bending steps are located between the fold lines formed by a preceding bending step which is one of the first through sixth (penultimate) bending step and which is prior to the subsequent bending step in the sequence. Each fold line appears as the vertex of an obtuse angle in FIG. 10.

Bending deformation is produced along each fold line, and internal stresses are distributed widely among the fold lines. Therefore, this production process can reduce the possibility of springback and improve the accuracy of forming.

The outside U-shaped surface of the strip are formed by the smooth sloping surfaces 14*a*~14*g* of the concave rolls 12*a*~12*g*. Therefore, the outside U-shaped surface is free of fold lines and other irregularities.

In the illustrated example, the number of the bending steps is seven. However, the invention is not limited to this. It is possible to decrease or increase the number of the bending steps.

Figure 12:
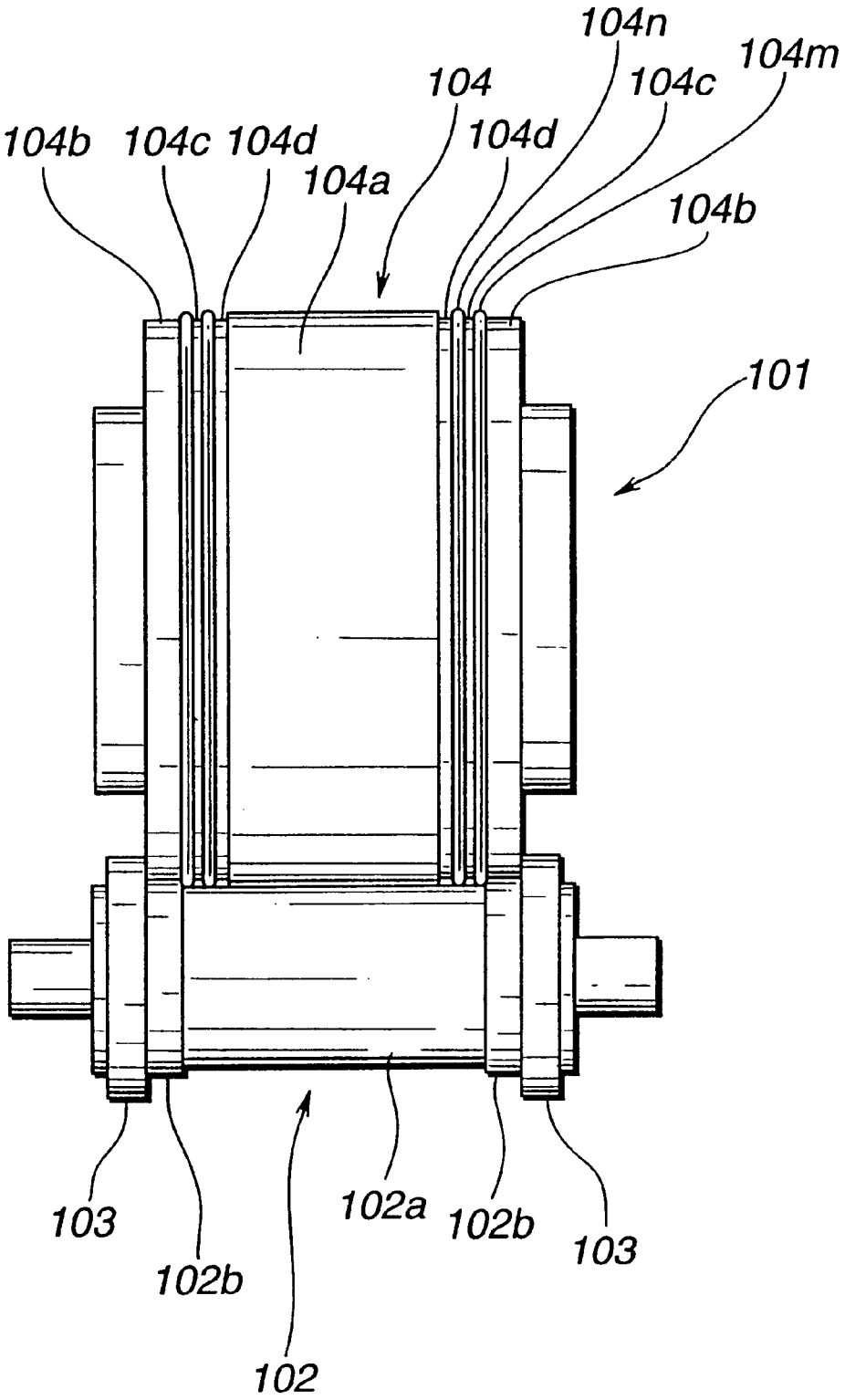
FIG. 12 is a front elevation of a roll set of a common roll 104 and a first selected roll 102 for forming flanges in a strip according to one method according to the present invention.

FIG. 12 shows a roll forming machine or roll set for forming one or more flanges in a strip, such as the flanges 3 of the metal strip 1 shown in FIG. 2A.

The flanging roll set shown in FIG. 12 includes a first roll (selective roll) 102 and a second roll (or common roll) 104.

Figure 16A:
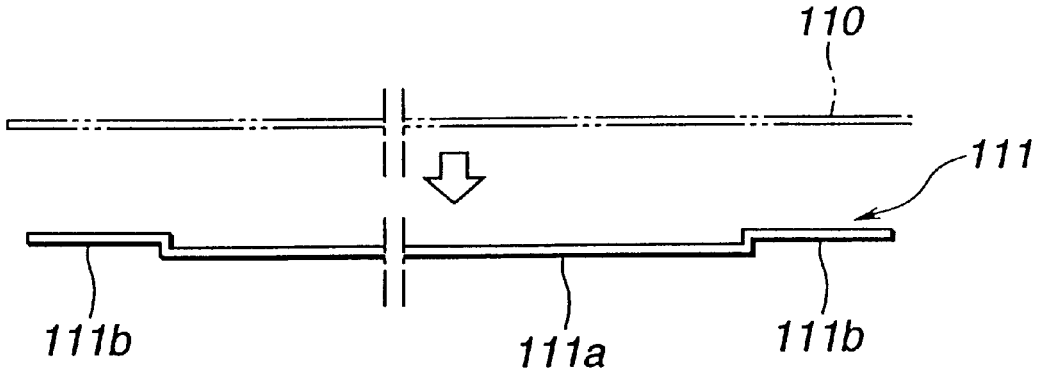
FIGS. 16A, 16B and 16C are views for showing flanged strips formed, respectively, by the roll sets of FIGS. 13, 14 and 15.

The first roll 102 includes a center main roll section 102*a* having a center main roll surface for forming a flat center main section 111*a* in a strip 111 as shown in FIG. 16A. The first roll 102 further includes left and right side roll sections 102*b* each having a side roll surface for forming a flat flange 111*b* as shown in FIG. 16A. The center main roll section 102*a* is bounded axially between the left and right side roll sections 102*b*. The diameter of each side roll section 102*b* is greater than the diameter of the center main section 102*a*. Each flange 111*b* is raised from the main strip section 111*a*, and there is formed a step between the main section 111*a* and the flange 111*b*. The first roll 102 further includes left and right roll flanges 103 each abutting and sliding on the adjacent end surface of the second roll 104. The second roll 104 is always held in a correct position relative to the first roll 102 along the axial direction by being confined between the left and right roll flanges 103 of the first roll 102.

The second roll 104 includes a center main roll section 104*a* for compressing the center main section 111*a* of the strip 111 with the center main roll section 102*a* of the first roll 102, and left and right side roll sections 104*b* each having a side roll surface for forming one of the flanges 111*b* of the strip 111. Each side roll surface is depressed below the center main surface. The diameter of each side roll section 104*b* is smaller than the diameter of the center main roll section 104*a*. The center main roll section 104*a* is located axially between the left and right side roll sections 104*b*.

The second roll 104 further includes a left and right pair of first annular grooves 104*c* and a left and right pair of second annular grooves 104*d*. On each of the left and right sides, the first and second annular grooves 104*c* and 104*d* are located axially between the center main section 104*a* and the side roll section 104*b*. The first annular groove 104*c* is located axially between the second annular groove 104*d* and the side roll section 104*b*, and the second annular groove 104*d* is located axially between the center main roll section 104*a* and the first annular groove 104*c*. Between the first annular groove 104*c* and the side roll section 104*b*, there is formed a first annular projection (or land) 104*m*. Between the first and second annular grooves 104*c* and 104*d*, there is formed a second annular projection (or land) 104*n*.

Figure 16B:
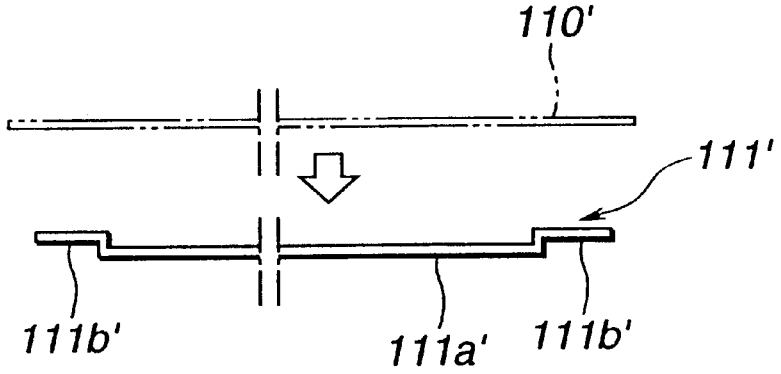

The left and right first annular grooves 104*c* are designed to form left and right flat flanges 111*b*' in a strip 111' shown in FIG. 16B. Each of the left and right first annular grooves 104*c* has predetermined axial position, width and depth corresponding to the position, axial width and the height of the flanges 111*b*'. The left and right second annular grooves 104*d* are designed to form left and right flat flanges 111*b*" in a strip 111" shown in FIG. 16C. Each of the left and right second annular grooves 104*d* has predetermined axial position, width and radial depth corresponding to the position, axial width and the height of the flanges 111"*b* shown in FIG. 16C.

Figure 13:
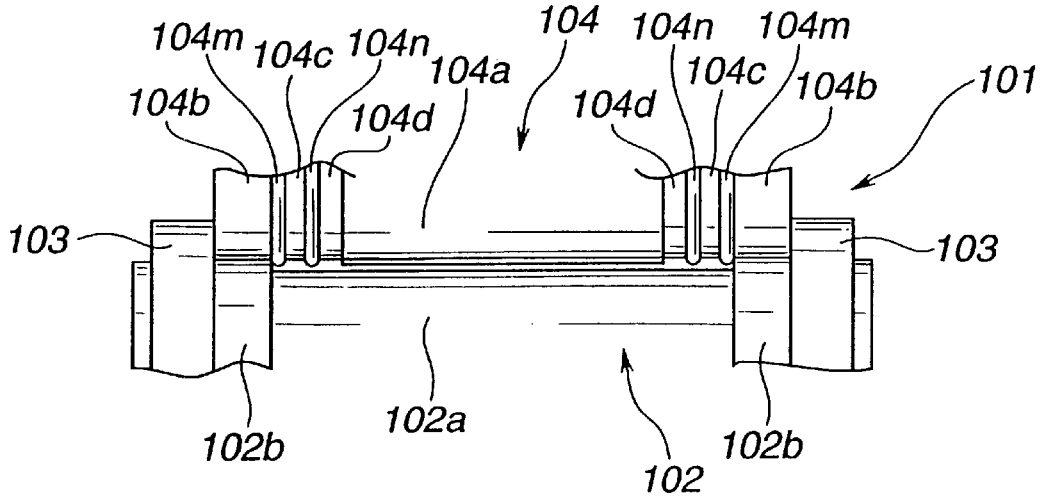
FIG. 13 is an enlarged view showing a part of the roll set of FIG. 12.

When the roll forming operation is performed with the first roll 102 and the second roll 104 as shown in FIG. 13, a flanged strip 111 of a wide width is formed, as shown in FIG. 16A, from a flat strip 110 such as a flat metal strip. The center main strip section 111*a* is compressed between the center main roll surfaces 102*a* and 104*a* of the first and second rolls 102 and 104. The left or right flange 111*b* of the flanged strip 111 on each of the left and right sides is formed by compression between the side roll surfaces 102*b* and 104*b* of the first and second rolls 102 and 104.

Figure 14:
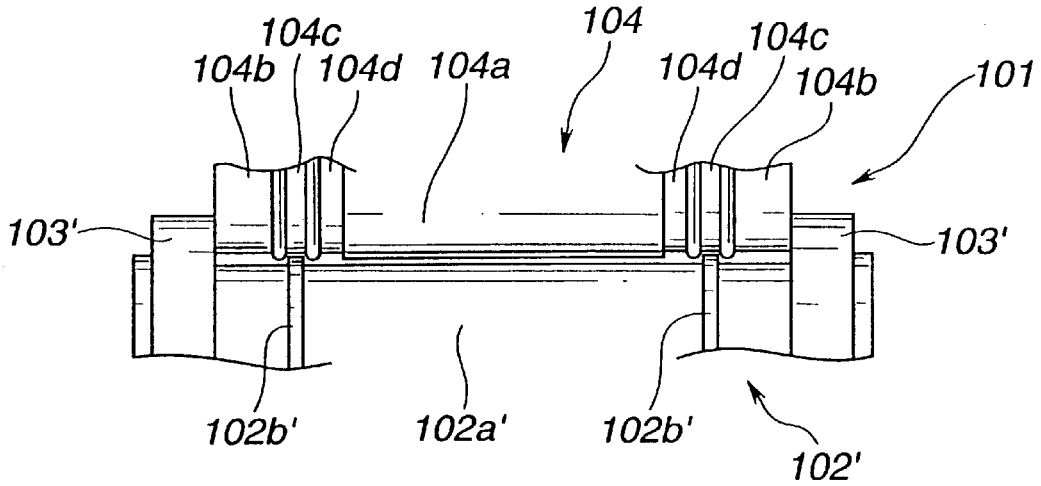
FIG. 14 is an enlarge view showing a roll set of the common roll 104 and a second selected roll 102'.

When the roll forming operation is performed with the second roll 104 and a first roll 102' as shown in FIG. 14, a flanged strip 111' of a medium width is formed, as shown in FIG. 16B, from a flat strip 110'. The center main strip section 111*a*' is compressed between the center main roll surfaces 102*a*' and 104*a* of the first and second rolls 102' and 104. Unlike the first roll 102 shown in FIG. 13, the first roll 102' of FIG. 14 has left and right annular projections 102*b*' each having a side roll surface. The left and right annular projections 102*b*' are correctly fit in the left and right first annular grooves 104*c* of the second roll 104, respectively, with a predetermined clearance. The left or right flange 111*b*' of the flanged strip 111' on each of the left and right sides is formed between the left or right first annular groove 104*c* of the second roll 104 and the side roll surface of the annular projection 102*b*' of the first roll 102' fit in the first annular groove 104*c*. The width of the flanged strip 111' shown in FIG. 16B is smaller than that of the flanged strip 111 shown in FIG. 16A. Moreover, the width of the center main section 111*a*' of the flanged strip 111' shown in FIG. 16B is smaller than that of the flanged strip 111 shown in FIG. 16A. In this example, the width of the left or right flange 111*b*' of the flanged strip 111' shown in FIG. 16B is smaller than that of the flanged strip 111 shown in FIG. 16A.

Figure 15:
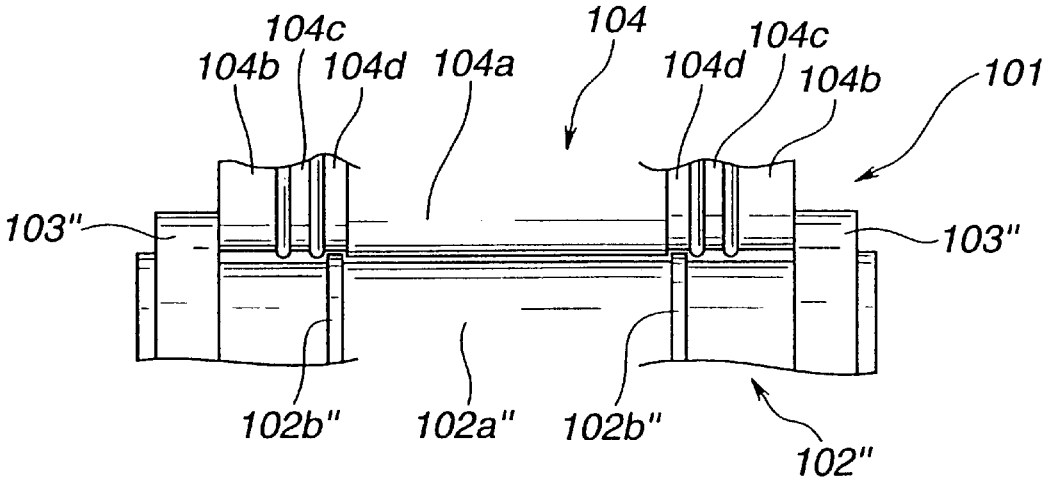
FIG. 15 is an enlarge view showing a roll set of the common roll 104 and a third selected roll 102".
Figure 16C:
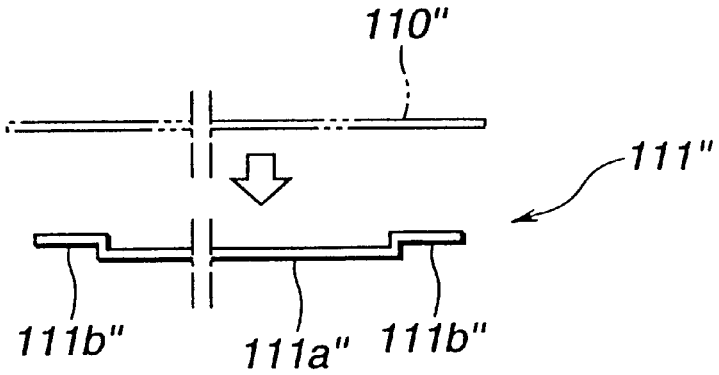

When the roll forming operation is performed with the second roll 104 and a first roll 102" as shown in FIG. 15, a flanged strip 111" of a small width is formed, as shown in FIG. 16C, from a narrow flat strip 110". The center main strip section 111*a*" is compressed between the center main roll surfaces 102*a*" and 104*a* of the first and second rolls 102" and 104. The first roll 102" has left and right annular projections 102*b*" each having a side roll surface. The left and right annular projections 102*b*" are correctly fit in the left and right second annular grooves 104*d* of the second roll 104, respectively, with a predetermined clearance. The left or right flange 111*b*" of the flanged strip 111" on each of the left and right sides is formed between the left or right second annular groove 104*d* of the second roll 104 and the side roll surface of the annular projection 102*b*" of the first roll 102" fit in the second annular groove 104*d*. The width of the flanged strip 111" shown in FIG. 16C is smaller than that of the flanged strip 111' shown in FIG. 16B. Moreover, the width of the center main section 111*a*" of the flanged strip 111" shown in FIG. 16C is smaller than that of the flanged strip 111' shown in FIG. 16B. In this example, the width of the left or right flange 111*b*" of the flanged strip 111" shown in FIG. 16C is equal to that of the flanged strip 111' shown in FIG. 16B.

The first roll 102' of FIG. 14 has left and right roll flanges 103' for positioning the second roll 104 correctly along the axial direction by limiting axial movement of the second roll 104 therebetween like the flanges 103 of the first roll 102 of FIGS. 12 and 13. Similarly, the first roll 102" of FIG. 15 has left and right roll flanges 103" for positioning the second roll 104 correctly along the axial direction by limiting axial movement of the second roll 104 therebetween.

In this way, it is possible to use the second roll 104 in common for forming flanged strips of different sizes by pairing with a selected one of the first rolls 102, 102' and 102" of different sizes, to the advantage of production cost.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A bending method of bending a metal strip from a flat shape into a folded shape having an approximately U-shaped cross section, the method comprising:

a first bending step of compressing the metal strip between a wider concave roll having a circumferential rim formed with a wider V-shaped groove defined by left and right sloping surfaces forming a wider spread angle and a wider convex roll having a circumferential rim formed with a wider ridge projecting toward a middle of the V-shaped groove between the left and right sloping surfaces and having a left edge for pressing the metal strip at a first left pressing point against the left sloping surface and a right edge for pressing the metal strip at a first right pressing point against the right sloping surface, and a second bending step of compressing the metal strip between a narrower concave roll having a circumferential rim formed with a narrower V-shaped groove defined by left and right sloping surfaces forming a narrower spread angle smaller than the wider spread angle of the first bending step and a narrower convex roll having a circumferential rim formed with a narrower ridge projecting toward a middle of the narrower V-shaped groove between the left and right sloping surfaces and having a left edge for pressing the metal strip at a second right pressing point against the left sloping surface and a right edge for pressing the metal strip at a second left pressing point against the right sloping surface, the second left pressing point and the second right pressing point being located between the first left pressing point and first right pressing point.

2. A bending method according to claim 1 wherein the metal strip bent by the first bending step includes left and right sloping walls extending on both sides of an imaginary median plane so as to form a V-shaped cross section bisected by the imaginary median plane, the left and right first and second pressure points are arranged substantially in a manner of bilateral symmetry on both sides of the imaginary median plane of the metal strip, the distance between the left and right second pressure points is smaller than the distance between the left and right first pressure points.

3. A bending method according to claim 1 wherein the bending method comprises a sequence of similar bending steps inclusive of the first bending step and the second bending step, for decreasing the bend angle of the metal strip step by step, an inserting step of inserting an inner member into a cavity of the metal strip bent by the sequence of the bending steps, and a closing step of closing edges of the metal strip to form a metal tube containing the inner member therein.

4. A bending method according to claim 3 wherein the bending method further comprises a flanging step of forming left and right flanges in the metal strip prior to the sequence of the bending steps.

* * * * *